US007523568B2

(12) United States Patent
Willey

(10) Patent No.: US 7,523,568 B2
(45) Date of Patent: Apr. 28, 2009

(54) SNOW PLOW

(76) Inventor: Barry A. Willey, 727 Ela Rd., Inverness, IL (US) 60067

( * ) Notice: Subject to any disclaimer, the term of this patent is extended or adjusted under 35 U.S.C. 154(b) by 361 days.

(21) Appl. No.: 11/383,514

(22) Filed: May 16, 2006

(65) Prior Publication Data

US 2007/0266599 A1 Nov. 22, 2007

(51) Int. Cl.
*E01H 5/04* (2006.01)

(52) U.S. Cl. ..... 37/231; 37/283

(58) Field of Classification Search ..... 37/232, 37/233, 283, 231
See application file for complete search history.

(56) References Cited

U.S. PATENT DOCUMENTS

| | | | | | |
|---|---|---|---|---|---|
| 184,690 | A | * | 11/1876 | Baker | 172/372 |
| 1,708,042 | A | * | 4/1929 | Abbe | 37/231 |
| 1,776,788 | A | * | 9/1930 | Gettelman | 37/232 |
| 1,847,133 | A | * | 3/1932 | Nieman | 37/283 |
| 2,166,424 | A | * | 7/1939 | Coates | 37/236 |
| 2,183,976 | A | * | 12/1939 | Smith | 294/54.5 |
| 2,426,410 | A | * | 8/1947 | Owen | 37/231 |
| 2,440,905 | A | * | 5/1948 | Maxim et al. | 37/283 |
| 2,468,950 | A | * | 5/1949 | Wiedman | 37/231 |
| 2,530,856 | A | * | 11/1950 | Callahan | 37/283 |
| 2,715,786 | A | * | 8/1955 | Dorko | 37/283 |
| 2,792,650 | A | * | 5/1957 | Kenyon | 37/234 |
| 2,854,766 | A | * | 10/1958 | Miller | 37/283 |
| 2,967,363 | A | * | 1/1961 | Meier | 37/283 |
| 3,374,717 | A | * | 3/1968 | Reynolds, Jr. | 404/114 |
| 3,422,553 | A | * | 1/1969 | Holloway | 37/231 |
| 3,464,129 | A | * | 9/1969 | Bogenschutz | 37/232 |
| 4,004,641 | A | * | 1/1977 | Hendrickson | 172/781 |
| 4,215,494 | A | * | 8/1980 | Farrell et al. | 37/236 |
| 4,369,590 | A | * | 1/1983 | Miller | 37/231 |
| 4,383,381 | A | * | 5/1983 | Wirsbinski | 37/283 |
| 4,754,562 | A | * | 7/1988 | McGarrah et al. | 37/232 |
| 5,088,215 | A | * | 2/1992 | Ciula | 37/197 |
| 5,615,745 | A | * | 4/1997 | Cross | 172/811 |
| 5,782,016 | A | * | 7/1998 | Feller et al. | 37/384 |
| 6,843,002 | B1 | * | 1/2005 | Moffitt | 37/231 |
| 6,957,505 | B1 | * | 10/2005 | Moffitt | 37/231 |

* cited by examiner

*Primary Examiner*—Thomas A Beach
(74) *Attorney, Agent, or Firm*—Vedder Price P.C.

(57) ABSTRACT

A snow plow with a clutch mechanism for allowing the plow blade to deflect when an off-center portion the blade strikes an obstacle.

The clutch comprises two plates in axial alignment, with one plate being attached to brackets for the plow support and the other plate being attached to brackets supporting the blade. One plate has a number of small protuberances and the other plate a corresponding number of shallow pockets. The plates are releasably held in nested relation by an axially adjustable mechanism.

5 Claims, 5 Drawing Sheets

SNOW PLOW

BACKGROUND OF THE INVENTION

The present invention relates generally to snow plows, and more particularly to snow plows that are used in conjunction with small, lightweight vehicles. For example, the snow plows of the present invention are especially adapted to be used, i.e., to be pushed, by lighter weight vehicles such as so called UTVs (utility vehicles), ATCs (all terrain cycles), ATVs (all terrain vehicles), and the like, usually powered with a 4 to 50 horsepower engines. Such snow plows have the ability to readily access snowy destinations and there to be run efficiently and at low cost. Many areas, particularly those wherein there is a moderate to large amount of snow, are particularly suited to being cleared by the plows of the present invention.

One of the difficulties that has been encountered with smaller, light weight plows of the type with which the invention is concerned, has been their inability to deal with unseen hazards such as tree stumps, sunken rocks or curbs, and parking place dividers made from concrete, and which are disposed toward the lateral edges of the plow. Such obstacles may be easily covered by snow, and when the snow plows encounter them, they are not seen by the operator until the blade contacts the obstacle at the edge or toward the edge of the plow. If such an obstacle is hit by the plow toward the center of the blade, the blade will tilt forward, and then skip over the obstacle. This does not create the risk of damage to the plow. However, off-center contact with existing units holds out the risk of damage, even serious damage, to the plow.

Most of the problems with snow plows such as those with which the present invention is concerned, is that whatever obstacles, such as parking place markers or tree stumps, are encountered at the outside edge of the plow create the risk of damage to the plow assembly. Because by far the majority of snow plowing is done with the blade at an angle to the direction of movement, the need for the invention is paramount.

Consequently, of most concern are obstacles of the above-mentioned kind lying toward the edge of the area being plowed.

It is therefore an object of the present invention to provide a safety device for a snow plow blades which would enable the blade of the plow, if struck well off center, to deflect or rotate rapidly without material damage, such blade being rotated about its vertical axis, that is, about the center of the structure supporting blade.

Another object is to provide a safety measure or protective device, particularly for the edge of a snow plow device.

It is a further object to provide such a safety device which will enable the plow blade to be deflected about from its stationary or pre-set position, to an offset or further position, and thereafter be able to reset to its original position without damage, so as to resume plowing.

A more particular object is to provide a snow plow mounting device which includes a novel clutch mechanism for holding the blade at a selected angle used in plowing, but which blade will rotate or deflect to a greater or less extent upon encountering a fixed object.

A further object is to provide an axially responsive safety clutch mechanism which may transiently disengage a fixed part from a rotary part if it encounters a hidden obstacle.

A still further object is to provide a safety clutch for mounting on a snow plow, the clutch preferably having a pair of domed plate members with one such plate having a large plurality of protruding portions or elements and the other plate having corresponding plural pockets, with the protuberances and the pockets being in nested relation, and the two plates being rotatable with respect to each other when the axial force holding them together is overcome.

A further object is to provide a clutch having a large number of stable positions, so that the plow may be deflected to varying extents, depending on the nature of the obstacle, the speed and angle of the plow, etc.

Another object is to provide such a clutch which may be adjusted for a desired break-away force.

Another object is to provide a clutch with an axial handle and a series of Belleville washers or springs which can readily adjusted for a predetermined break-away force merely by manipulating the handle.

SUMMARY OF THE INVENTION

These and other objects of the present invention are achieved in practice by providing a snow plow safety break-away clutch having a first plate closely overlying a somewhat similar second plate, with one plate having a plurality of male formations and the other plate having a plurality of pockets, with the plates being held in nested relation under an adjustable, axial spring force, allowing plates to ride over each other in predetermined steps when encountering a specific, predetermined load.

The manner in which these and other objects and advantages of the invention are achieved in practice will become more clearly apparent when reference is made to the following detailed description of the preferred embodiment of the invention, and shown in the accompanying drawings in which like reference numerals indicate corresponding parts throughout.

DESCRIPTION OF THE PREFERRED EMBODIMENTS OF THE INVENTION

While the invention may be practiced in a number of ways, an example will be given of one presently preferred method and apparatus for practicing the invention.

Figure 2:
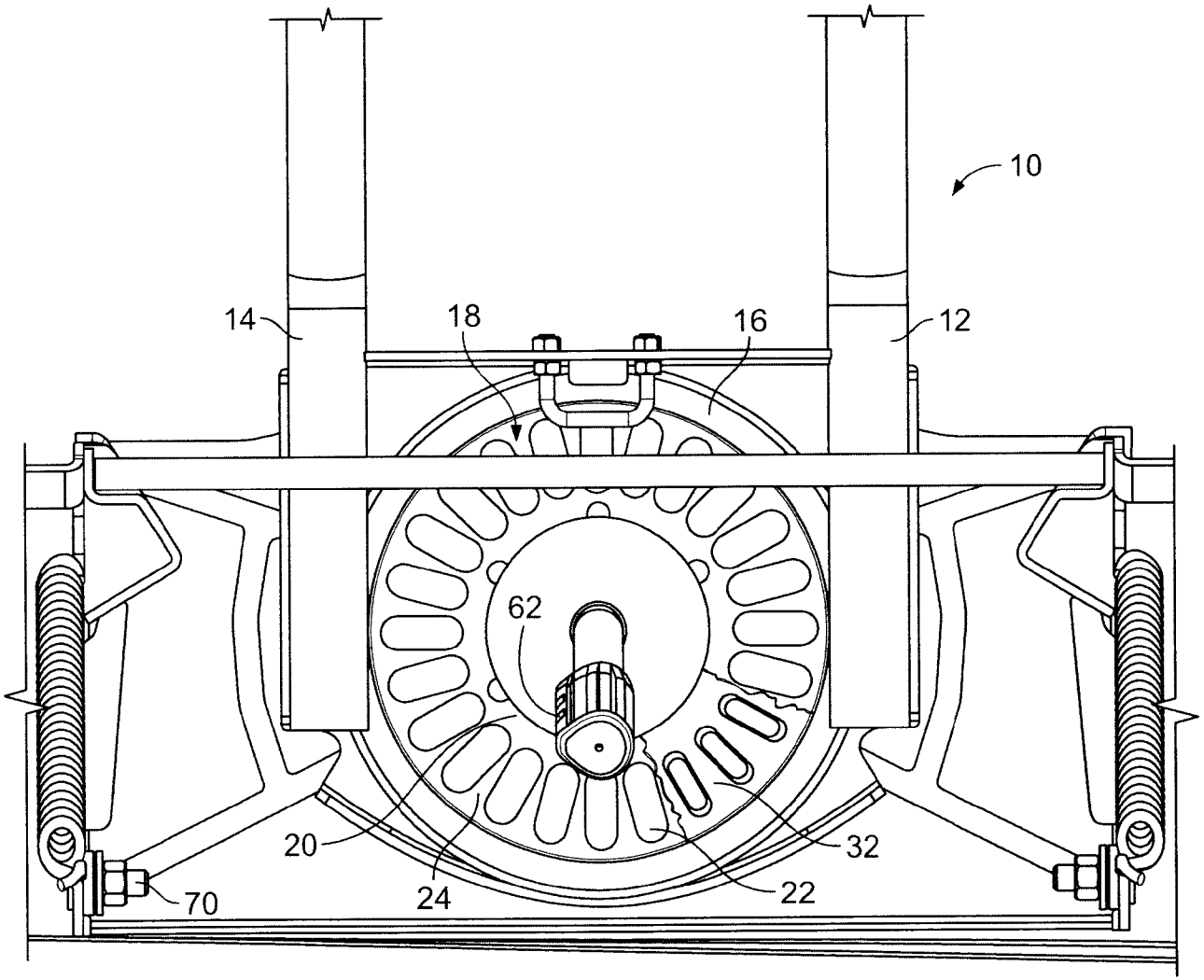
FIG. 2 is an enlarged view of the safety clutch of the invention with a portion of the upper safety clutch broken away to show the form of the lower half of the safety clutch; and showing the springs mounted on the plow for allowing the plow to tilt forward when striking an obstacle toward the center of the plow.
Figure 3:
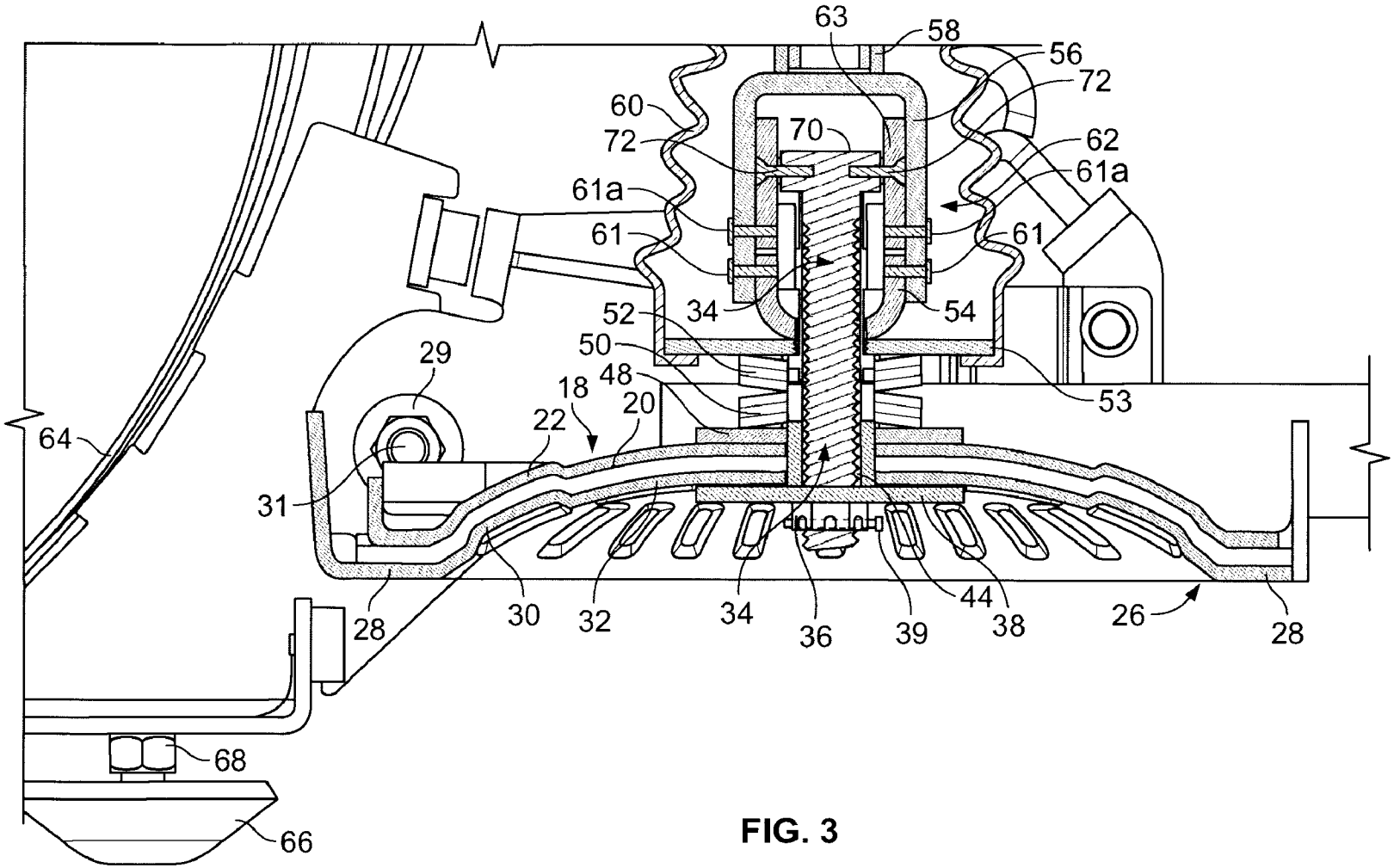
FIG. 3. is a further enlarged vertical sectional view, with portions exploded, showing the oval-shaped male and female formations on the two plates when they meet with each other, and showing certain aspects of the Belleville washer springs, and other means for applying an axial load to the clutch mechanism.
Figure 4:
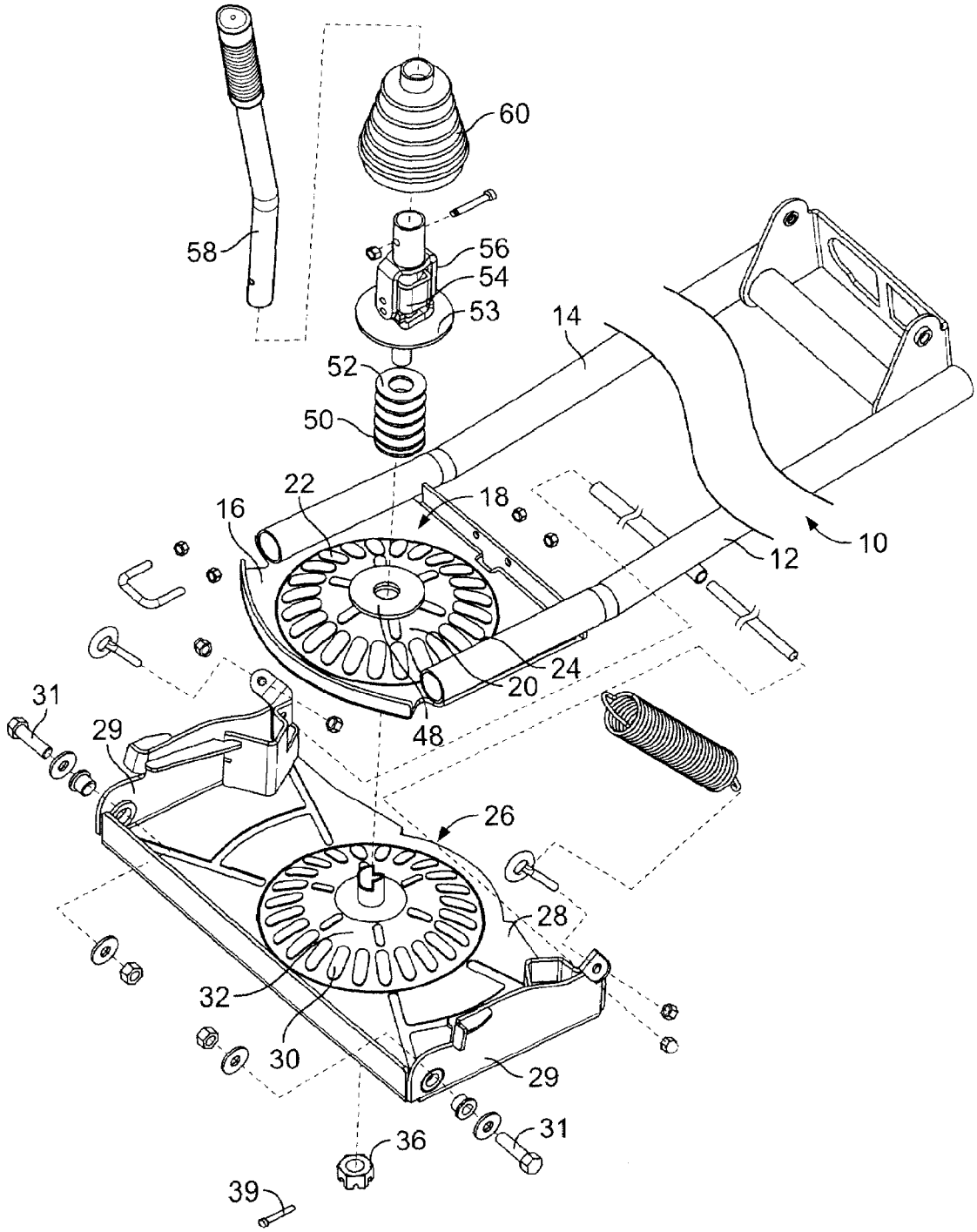
FIG. 4 is an exploded perspective view of the plow of the present invention, showing one clutch member affixed to a vehicle and the other clutch member affixed to the plow support.
Figure 5:
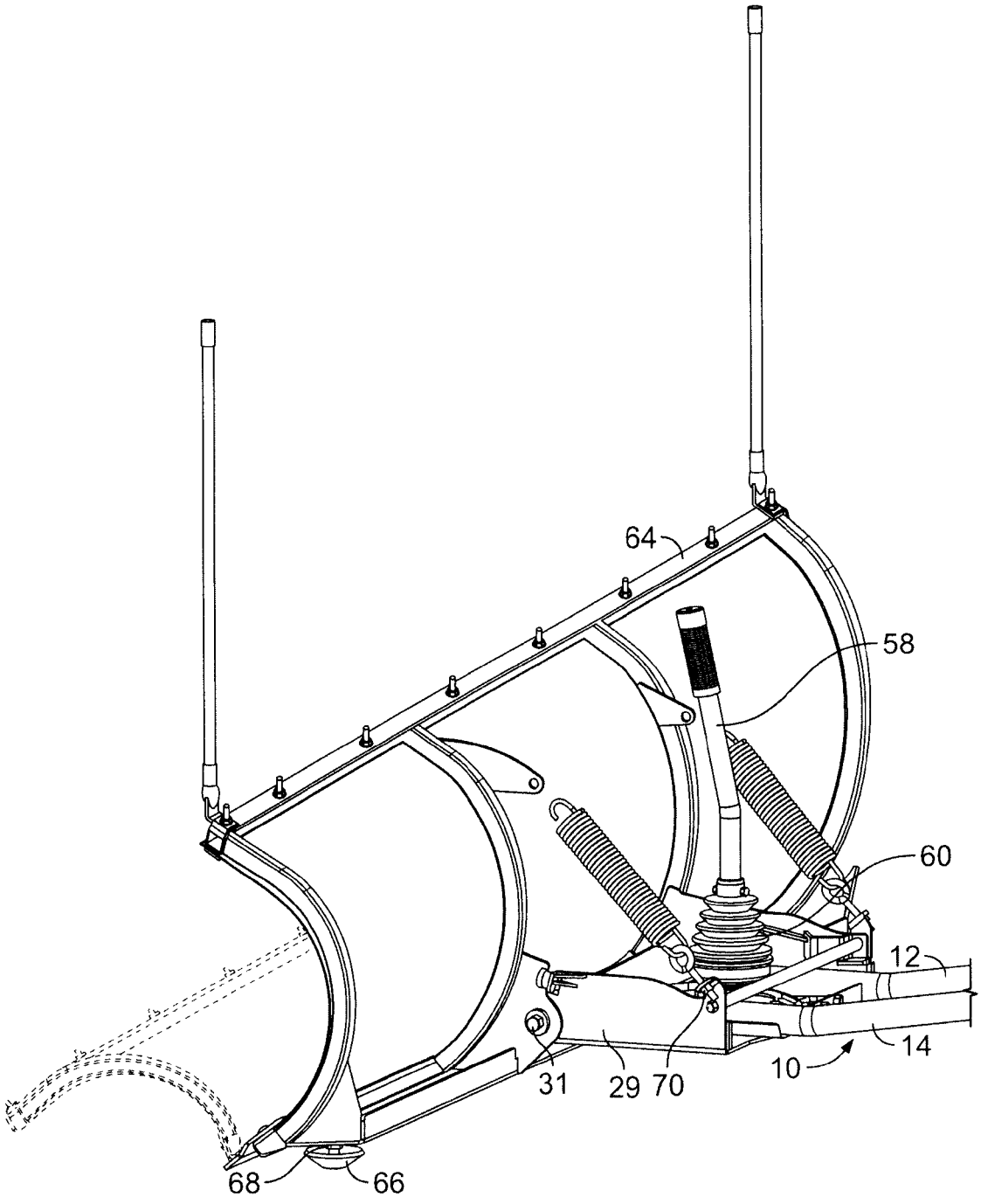
FIG. 5 is a perspective view of the plow, showing how the plow tilts when encountering a fixed object in the center of the blade.

Referring now to the drawings in greater detail, and in particular to FIGS. 2-4, there is shown a frame assembly generally designated 10 with a pair of mounting brackets 12, 14 which are affixed at their remote ends to the lower portion of a vehicle (not shown), and attached at their other end to the outer flat margin 16 of an upper clutch plate generally designated 18. The upper clutch plate 18 has a generally slightly domed structure 20 with plural, spaced apart female portions in the form of pockets 22, which extend vertically a very short distance, say ¼ to ½ inch, for example. There is a space 24 (FIG. 2) between the pockets 22, of which there are a large plurality, arranged in a circle when viewed from the top as in FIG. 2, for example.

FIGS. 2-4 also show another slightly domed clutch plate generally designated 26, having an outer margin 28 with plural spaced apart male protuberances 30 adapted to nest within in the female pockets 22. The outer margin 28 of the plate 28 has turned-up ends 29 for being secured to the plow by fasteners 31. The remainder 32 of the lower domed clutch plate 32 is generally congruent with the shape of the upper clutch plate 20. Although shown spaced apart for ease of understanding, the two plates 20, 32 are normally snugly engaged with each other, held by whatever force is applied, as will appear.

An adjustable central, force applying member generally designated 34 is shown to include a lower nut 36 for engaging the lower disk 38. A cotter key 39 holds the nut 36 in place. The large, force-applying member or bolt 34 extends vertically downwardly and has counterpart threads 44 on its outside diameter. The disk 38 lies between the nut 36 and the lower clutch plate 32.

A large flat intermediate disk 48 is provided to entrap the arrays of Belleville washers 50, 52 between the intermediate disk 48 and the uppermost disk 53.

The upper disk 53 is firmly engaged by a clevis 54 having one u-shaped portion 56 affixed to the handle 58 engaged therewith. Fasteners 61, 61 extend between the upper and lower clevis portions 54, 56 thus completing this assembly 62. The entire assembly 62 is covered by a rubber or like boot 60, which keeps the assembly relatively free from collecting snow, dirt or the like. A link 63 is connected at one end to the bolt 70 by a fastener 72 and the other end of the link 63 is attached by fastener 61*a* to the lower portion of the upper clevis half.

Accordingly, as can be seen, when the bolt 42 is engaged by the handle 56, 58 and turned in a clockwise manner, the disk 36 will begin to force the disk 48, and the threaded disk 53 toward engagement with each other. Once the nut 36 and the disks 46, 48, 53 are engaged with one another and the protuberances 30 extend fully into the pockets 22, the plates no longer move without additional load. An additional load may then be placed thereon by compressing the Belleville washers 50, 52 to any desired extent. This load may be thought of as adding to the resistance of the domed plates 18, 26 to turning relative to each other. For this purpose, the handle portion 58 of the shaft is able to be twisted about relatively easily until the pair of Bellevilles 50, 52 are engaged and then with an increased force while the bolt 42 is tightened.

The remaining portion consists of the plow assembly generally designated 62, the mold board 64, the feet 66 with an adjusting screw 68 thereon. The outer margin 28 of the lower plate 26 is shown as being attached by fasteners 31 to the snow plow 62 itself.

Figure 1:
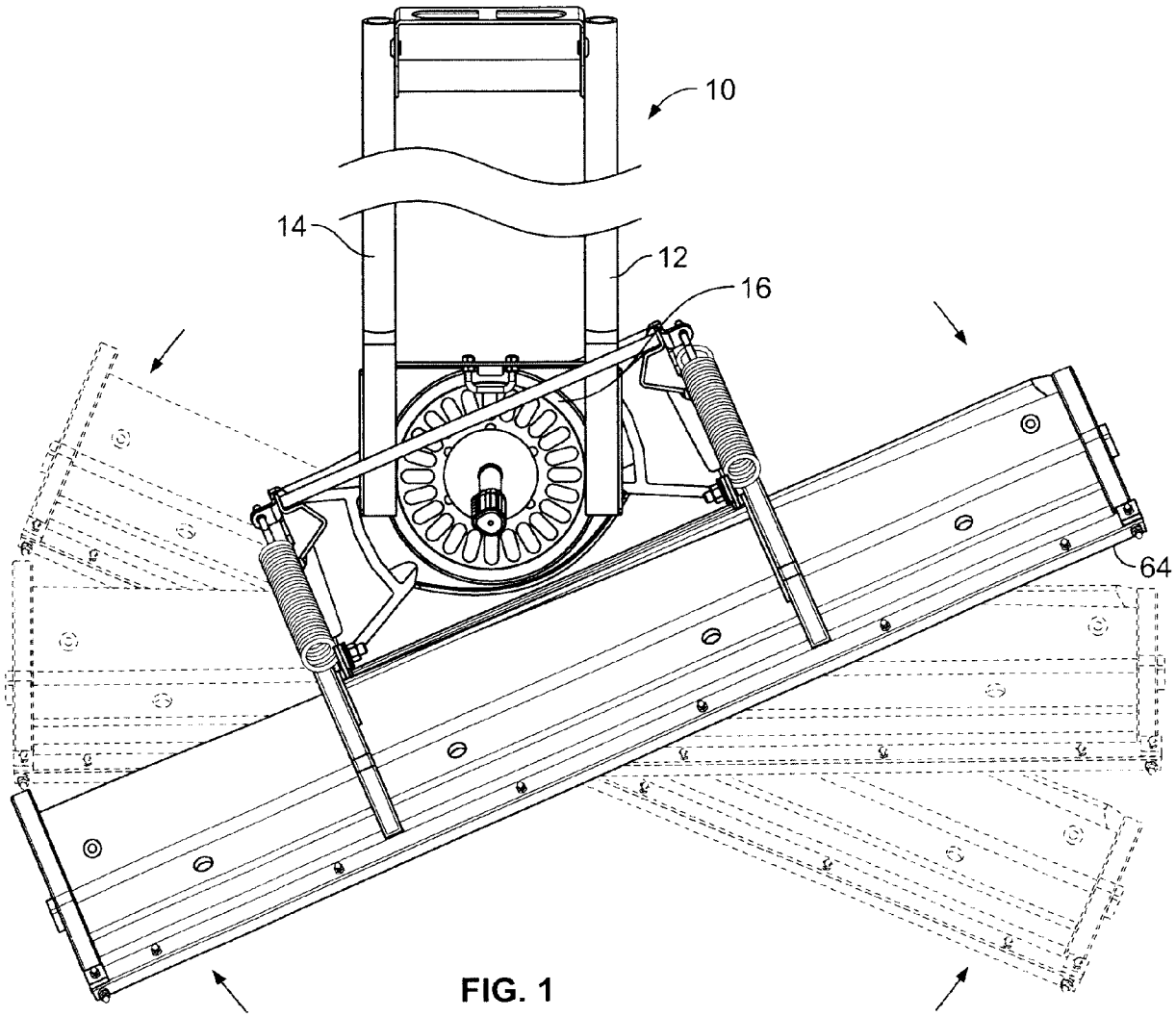
FIG. 1 is a top plan view of a snow plow, showing a pair of struts for attachment of the plow to an all terrain vehicle, a snow plow in three different positions and the safety clutch assembly of the present invention shown in the middle thereof.

When it is time to use the snow plow, the mold board 64 of the plow is set at a desirable angle, 95°-120° to the direction of travel. Thereupon, the plow is lowered until the feet 66 and the mold board 64 of the plow are in the appropriate position just contacting the snow-covered surface beneath the accumulated snow. The snow is thereafter plowed without incident. However, when the plow, particularly an outer edge of the plow, meets an obstruction which is immovable, the plow deflects backward as shown in FIG. 1, and this backward movement causes the lower plate 28 to rotate relative to the upper plate 20 about the axis of the bolt 42.

The protuberances 30 which have extended into the pockets 22 are temporarily dislodged by the force of the off center striking of the plow, depending on the degree to which the plates 48, 53 permit the upper and lower plates 20, 32 to be rotated. After such an incident, the handle 58 is then manipulated so as to lessen the compression on the Belleville washers, and the plates 18, 26 are reset to the desired degree.

Thereupon, the plow and mold board being replaced at their desired angle, the handle 58 and the bolt 42 are then rotated clockwise, again bringing the pockets 22 and the protuberances 30 into close contact with a desired residual load on them. One advantage, among others, is that the contoured plates slip with respect to each other, but only a very small degree, and presumably, in the event of a major encounter, would rotate around until the edge of the plow is in one of the dotted line positions shown in FIG. 1. This would involve moving perhaps five or six pockets upon impact. Depending on the blade angle and the nature of the obstacle, the plate will move appropriately.

A few modifications are possible without departing from the spirit of the invention. For example, while dome-shaped plates are preferred, the plates could be flat or frusto-conical. The pockets and the protuberances could be eccentric, e.g., allowing one direction to be ramped or the like, with rotation in the other direction having a steeper angle. Belleville washers are preferred, but not strictly necessary. In fact, if the dome effect on one plate is slightly different (a shallower or steeper dome) from the other, one could use this difference as a spring, and thus have fewer Belleville washers or possibly none at all. The degree of rotating of the plates is shown as being limited, but this need not be exactly as illustrated. There are several other changes and modifications that are possible.

It will thus be seen that the present invention provides a novel snow plow including a clutch release mechanism having a number of advantages and characteristics, including those pointed out above and others which are inherent in the invention.

What is claimed is:

1. A snow plow having a plow face structure, said plow face being mounted for rotation about a substantially vertical axis and affixed to a first plate of a clutch mechanism, said first clutch plate being circular in plan, and having a large plurality of generally vertically extending protuberances spaced about its outer periphery; a second clutch plate attached to brackets for attaching said snow plow to a vehicle, and being axially aligned with said first clutch plate, said second plate having plural pockets constructed and arranged for receiving said protuberances from said first plate in nested relation, said first and second clutch plates having shallow, domed configurations an axially extending member including resilient means exerting a force for holding said plates in said nested relation, said plate having shallow, domed configurations, whereby, when said plow face strikes an obstacle that is located off center with respect to said plow face, said off-center strike tends to overcome the force holding said clutch plates together and allows said first clutch plate to rotate relative to said second clutch plate.

2. A snow plow as defined in claim 1 wherein said resilient means comprises plural dished washers.

3. A snow plow as defined in claim 1 in which said axially extending member includes a handle, and said resilient means comprises dished washers.

4. A snow plow having a plow face structure, said plow face being mounted for rotation about a substantially vertical axis and affixed to a first plate of a clutch mechanism, said first clutch plate being circular in plan, and having a large plurality of generally vertically extending protuberances spaced about its outer periphery; a second clutch plate attached to brackets for attaching said snow plow to a vehicle, and being axially aligned with said first clutch plate, said second plate having plural pockets constructed and arranged for receiving said protuberances from said first plate in nested relation, an axially extending member including a rotatable handle, a clevis, a bolt and at least one threaded force applying plate being constructed and arranged for applying a compression load for said plates in said nested relation, whereby, when said plow face strikes an obstacle that is located off center with respect to said plow face, said off-center strike tends to overcome the force holding said clutch plates together and allows said first clutch plate to rotate relative to said second clutch plate.

5. A snow plow having a plow face structure, said plow face being mounted for rotation about a substantially vertical axis and affixed to a first plate of a clutch mechanism, said first clutch plate being circular in plan, and having a large plurality of generally vertically extending protuberances spaced about its outer periphery; a second clutch plate attached to brackets for attaching said snow plow to a vehicle, and being axially aligned with said first clutch plate, said second plate having plural pockets constructed and arranged for receiving said protuberances from said first plate in nested relation, an axially extending member including resilient means exerting a force for holding said plates in said nested relation, said plates having shallow, frusto-conical shapes, whereby, when said plow face strikes an obstacle that is located off center with respect to said plow face, said off-center strike tends to overcome the force holding said clutch plates together and allows said first clutch plate to rotate relative to said second clutch plate.

* * * * *